US007942283B2

(12) United States Patent
Radow

(10) Patent No.: US 7,942,283 B2
(45) Date of Patent: May 17, 2011

(54) DISPENSER ASSEMBLY

(76) Inventor: Marc Radow, Rancho Palos Verdes, CA (US)

( * ) Notice: Subject to any disclaimer, the term of this patent is extended or adjusted under 35 U.S.C. 154(b) by 445 days.

(21) Appl. No.: 10/797,401

(22) Filed: Mar. 9, 2004

(65) Prior Publication Data

US 2005/0199622 A1 Sep. 15, 2005

(51) Int. Cl.
*A47G 19/00* (2006.01)
*B65D 21/02* (2006.01)

(52) U.S. Cl. ..... 220/23.86; 220/4.27; 118/13

(58) Field of Classification Search ..... 220/4.27, 220/23.86, 23.87, 23.88, 23.89, 500, 506, 220/527, 528; 206/216, 505, 514, 528; 426/115, 426/120; 118/13
See application file for complete search history.

(56) References Cited

U.S. PATENT DOCUMENTS

| | | | | |
|---|---|---|---|---|
| 2,614,727 | A | 10/1952 | Robinson | |
| 3,272,383 | A * | 9/1966 | Harvey | 220/608 |
| 3,349,941 | A * | 10/1967 | Wanderer | 220/23.88 |
| 3,450,096 | A | 6/1969 | Lancette | |
| 3,942,673 | A * | 3/1976 | Lyu et al. | 220/608 |
| D241,399 | S | 9/1976 | Christian | |
| 4,042,143 | A * | 8/1977 | Biggins | 220/256.1 |
| 4,184,444 | A * | 1/1980 | Woodley | 413/31 |
| 4,405,058 | A * | 9/1983 | Phalin | 220/62.13 |
| 4,646,930 | A | 3/1987 | Karas et al. | |
| D291,181 | S | 8/1987 | Franco | |
| 4,880,129 | A | 11/1989 | McHenry et al. | |
| 5,234,126 | A * | 8/1993 | Jonas et al. | 220/609 |
| 5,474,184 | A * | 12/1995 | Mandler et al. | 206/519 |
| 5,573,698 | A * | 11/1996 | Mandler et al. | 510/277 |
| 5,743,423 | A | 4/1998 | Franco | |
| 6,265,010 | B1 | 7/2001 | Franco | |
| D505,833 | S | 6/2005 | Ahearn | |
| D513,821 | S | 1/2006 | Kenig | |
| 2004/0206302 | A1 | 10/2004 | Propp | |
| 2006/0201417 | A1 | 9/2006 | Radow | |

FOREIGN PATENT DOCUMENTS

| | | | |
|---|---|---|---|
| GB | 2119743 A | * | 11/1983 |
| JP | 03243231 A | * | 10/1991 |
| WO | WO92/20587 | | 11/1992 |

OTHER PUBLICATIONS

CR Manufacturing, Marga-Ezy Rimmer, Jun. 7, 2005, 2 pages, www.crmfg.com/product_index/p18.html. Planet Sugar, Cocktail Candy, Jun. 7, 2005, 2 pages, www.cocktailcandy.com/ccandy/ccandy.html. Rokz, Rimmers, Jun. 7, 2005, 2 pages, http://www.rokz.com/. Wildly Delicious, Glass Rimmer, Jun. 7, 2005, 3 pages, www.wildlydelicious.com/twilight_cocktail_rimmers.htm.

* cited by examiner

*Primary Examiner* — Anthony Stashick
*Assistant Examiner* — Harry A Grosso
(74) *Attorney, Agent, or Firm* — Lewis and Roca LLP

(57) ABSTRACT

A method and a device for preparing a drinking glass, cup, mug or other beverage container, e.g. drink-ware, where any dry granular, flaked, shaved or powder substance (SPICE) is applied to the rim of the drink-ware. Where the drink-ware is inverted and introduced into the SPICE and in order to adhere the SPICE to the rim of the drink-ware, the rim is customarily first moistened with a liquid, gel or other viscous aqueous wetting substance (moistening agent). The dispenser is an all encompassing system to accommodate common large diameter drink-ware, to moisten the rim of the drink-ware, house the SPICE, preserve the moistening agent and preserve the SPICE by separating the moisture of the wetting agent from the SPICE, providing for drink-ware to be introduced into the wetting agent then into the SPICE and to re-close and secure the device and its contents with a screw or snap-on lid.

32 Claims, 7 Drawing Sheets

Figure # 1
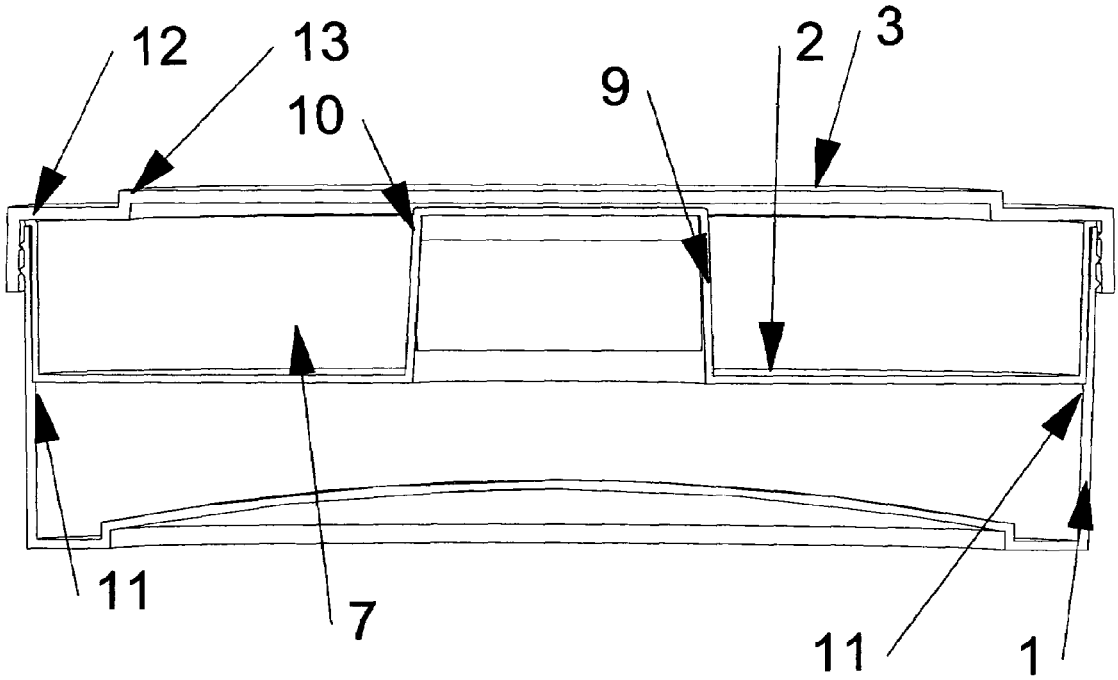

Figure # 2
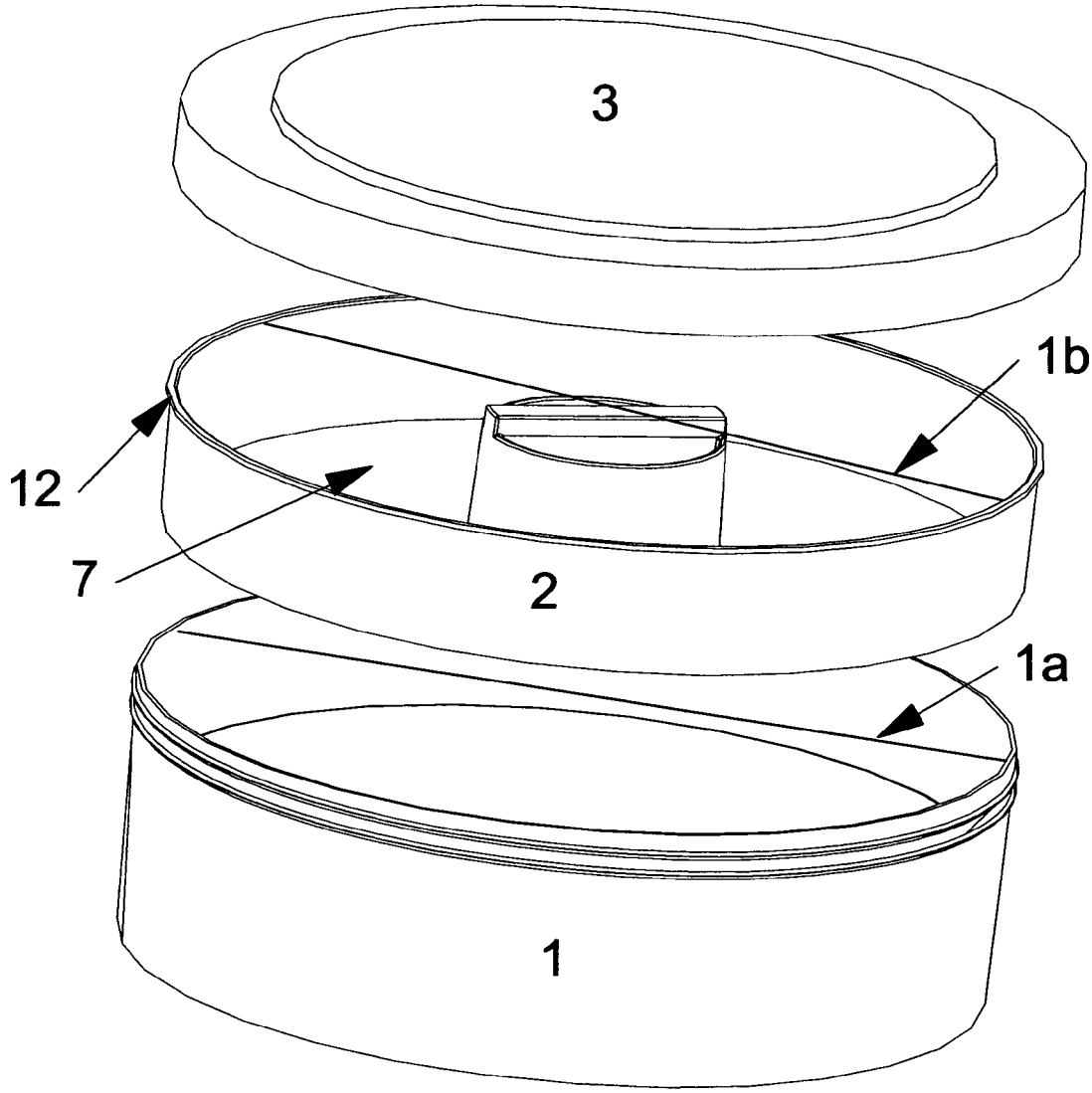

Figure # 3
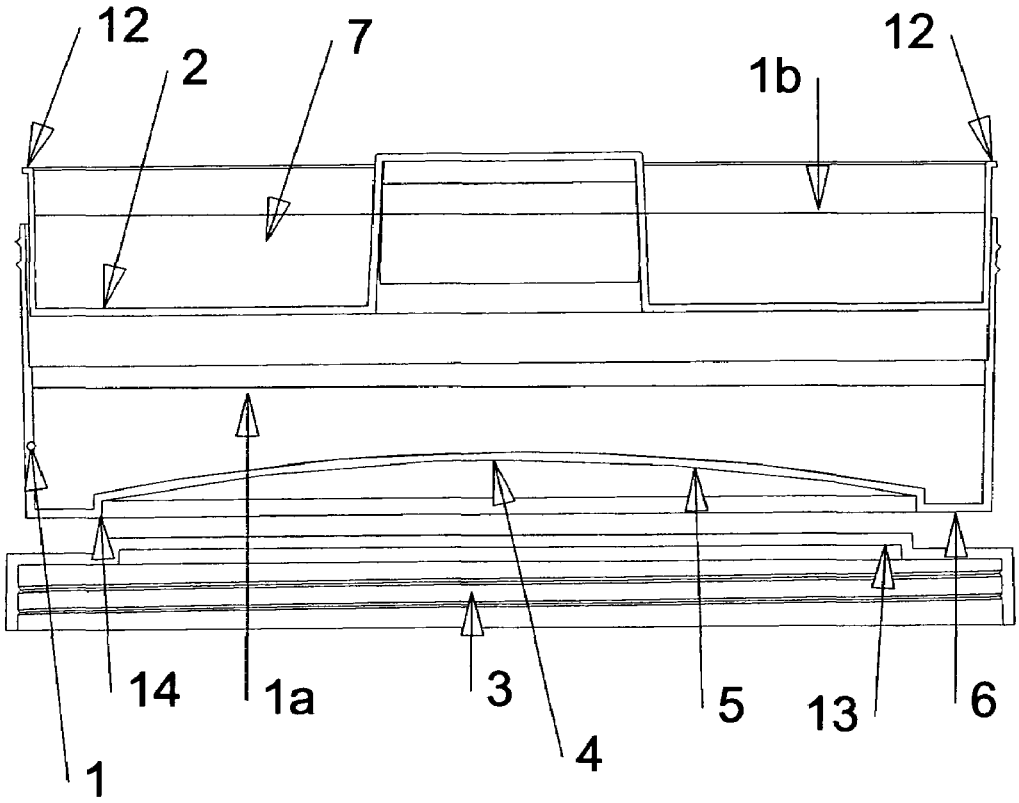

Figure # 4
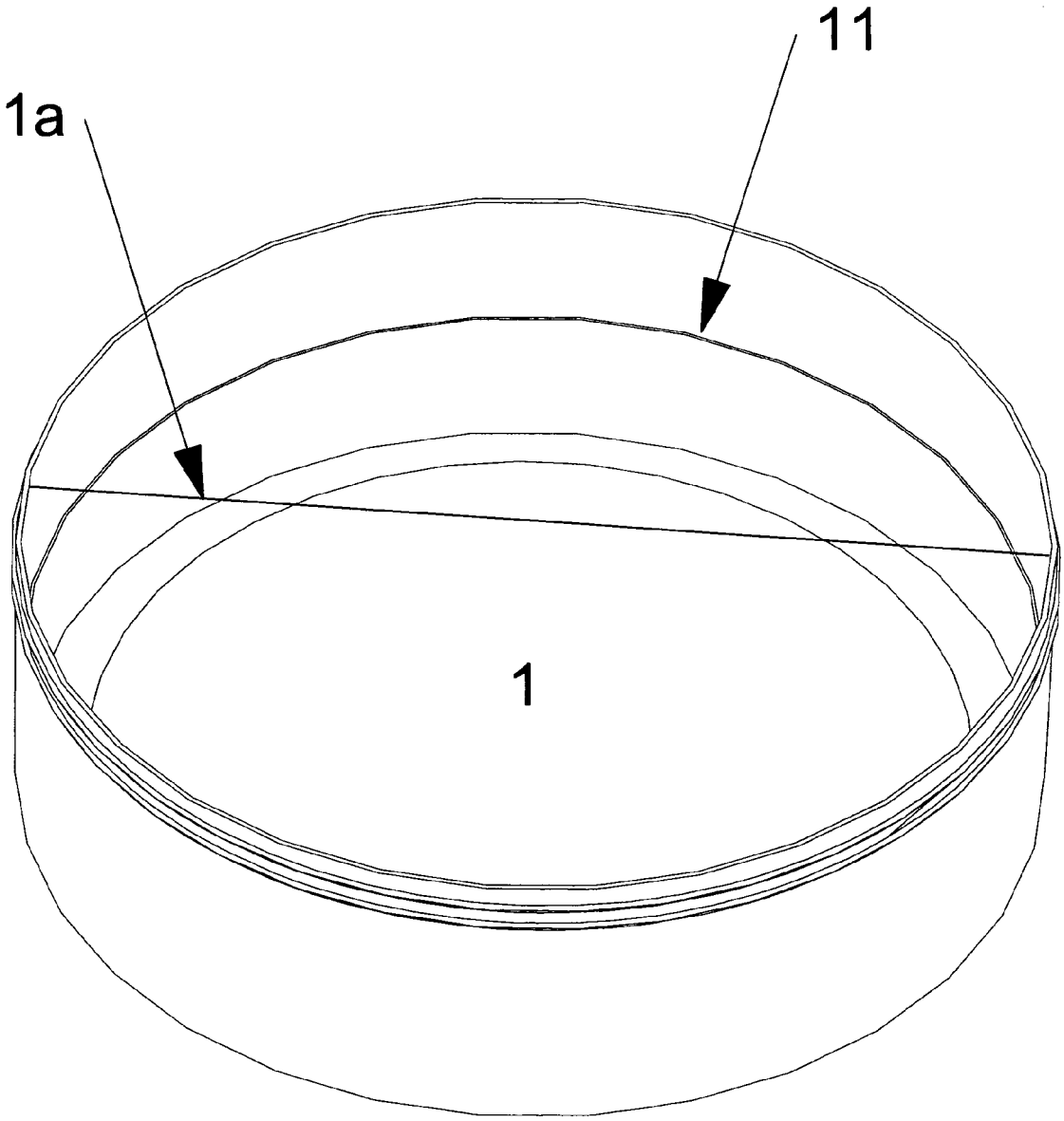

Figure # 5
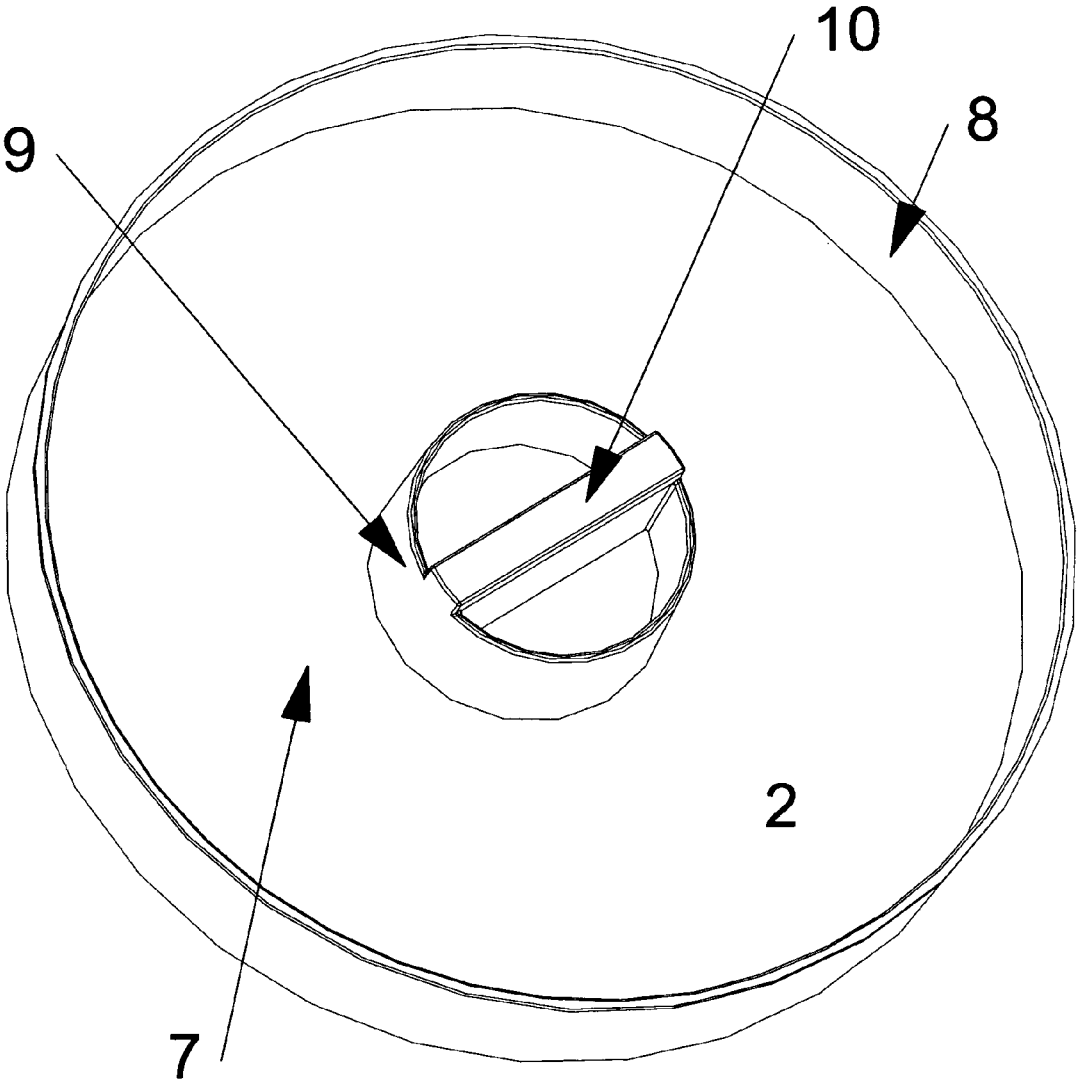

Figure # 6
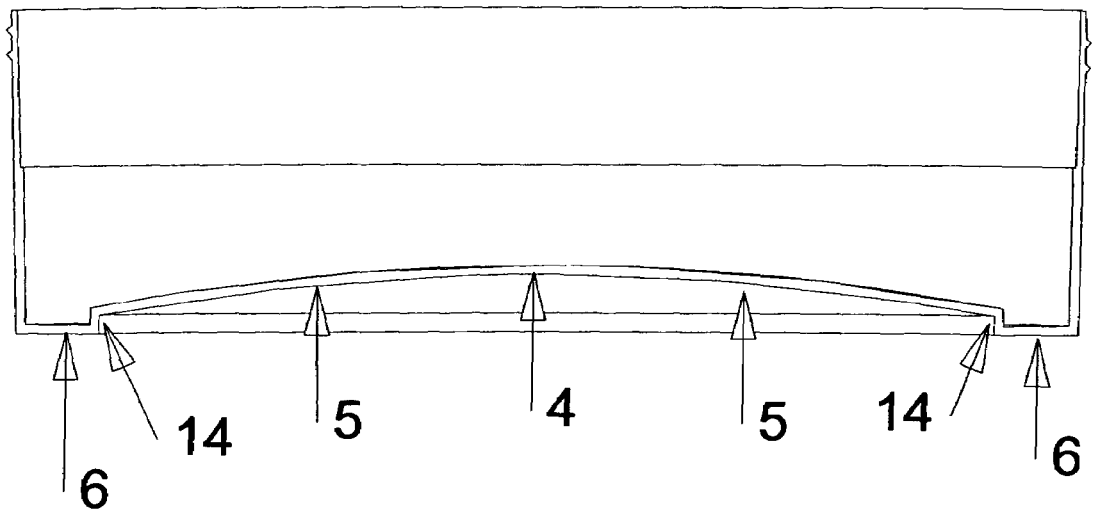

DISPENSER ASSEMBLY

BACKGROUND OF THE INVENTIONS

This invention relates to a novel method and a novel device for applying a material, including SPICE or any dry granular, flaked, shaved or powder substance, to the rim of drink-ware in the preparation of a beverage of any type, nature, alcoholic or otherwise.

Rimming drink-ware for beverages unto itself is not novel. The margarita, a cocktail which is generally made with tequila liquor mixed with lime, lemon and other juices and cordials has been served in drink-ware whose rims were coated with salt. This salt application process had been accomplished by moistening the rim of the glass and inserting the moistened rim into a dish or reservoir of salt.

Current containers provide for varying degrees of dimension to accommodate the introduction of common wide mouthed drink-ware such as Martini, Rocks, Highball and other glasses into the container filled with SPICE for the purpose of applying the Spice to the rim of the drink-ware.

Saturated sponges and reservoirs have been used with a wetting agent to moisten the drink-ware's rim when drink-ware is inverted and introduced/depressed into the sponge or reservoir. Then the drink-ware, again inverted, is introduced into the SPICE in the container or plate to apply the SPICE onto the rim of the drink-ware.

Rimming drink-ware however has grown in popularity as on-premise establishments (e.g. restaurant, nightclub, cafe, bar, tavern, etc.) strive to improve perceived drink values, reduce costs and/or offer presentations that otherwise consumers may not readily have access to. As new beverage concoctions have flooded the marketplace, so too has the complexity of SPICE preparations exploded. Formerly, common salt (as identified in the above Margarita example) and sugar were used to rim drink-ware. Today, a number of formulations varying in combinations of colors, flavors, textures and a host of food science ingredients have been created and intended for this specific rimming purpose.

Where traditional salt and sugar compounds had no added ingredients and remain relatively inexpensive, there had been little or no cause for handling with increased care, protecting or preserving them. For example, excess or remaining salt or sugar could easily be discarded without incurring a substantial cost.

Conversely, the formulations today include expensive flavors, colors and food ingredients for specific performance criteria. The preparations can be expensive and demand care. Further, the rimming ingredients, the introduction of moisture, humidity and air can be corrosive to packaging and/or detrimental to the SPICE. Current containers are neither sufficient to preserve their contents, they hide from view their contents, many are of insufficient diameter to accommodate the mouth/opening of the drink-ware, and do not afford the convenience to rim drink-ware effectively.

BRIEF SUMMARY

Examples of methods and apparatus are provided that are directed to novel methods of applying a material, for example SPICE (dry granular, flaked, shaved or powder substance—hereafter referred to as SPICE), to common drink-ware and also to novel apparatus such as a dispenser. In one example, the dispenser includes a container for the SPICE, rimming dish, sponge and lid for use in one example of that method.

In accordance with one example, a wetting or coating agent (hereafter referred to as a wetting agent) is applied to and saturates the sponge. The drink-ware is inverted and introduced into the sponge to moisten the rim of the drink-ware. The drink-ware, again inverted, is introduced into the said container which houses the SPICE which adheres to the rim of the drink-ware.

A principal object of this invention is to provide a novel and improved method of preparing a beverage with drink-ware whose rim is coated with a SPICE. In one example, it will use gravity to more efficiently utilize the SPICE product, reduce waste, and allow for the SPICE to more completely extend over the drink-ware's rim. Users will more easily and conveniently handle the rim dish and sponge when saturated with a wetting agent in order to remove and re-insert the rim dish and sponge from and into the said container. The dispenser will allow users to easily stack and utilize more than one dispenser (e.g. one container houses one Spice and more than one SPICE type may be desired while preparing one or more beverages, with each dispenser containing different SPICE types).

The example of the dispenser depicted herein provides for the aforementioned features and conveniences. However, one of more of the benefits of the designs exemplified herein can be achieved by using fewer than all of the features even though all of the features may not be incorporated into a single assembly. Further objects and advantages of this invention will be apparent from the following detailed description of presently preferred embodiments with reference to the accompanying drawings.

BRIEF DESCRIPTION OF THE DRAWINGS

FIG. 1 is a sectional view of the dispenser showing the lid, rim dish, area for the sponge and container in accordance with one or more novel aspects of the present invention for use in practicing the methods described in this invention.

FIG. 2 is a perspective view of a dispenser (lid, rim dish and container) in accordance with one or more novel aspects of the present invention and for use in practicing the method of this invention;

FIG. 3 is a sectional view of the dispenser showing the lid underneath the container demonstrating one novel aspect of the dispenser (e.g. stacking one or more dispensers on top of the other) of the present invention.

FIG. 4 is a perspective view of the container which houses the SPICE (dry granular, flaked, shaved or powder) substance.

FIG. 5 is a perspective view of the rim dish which accommodates the wetting agent to moisten the rim of drink-ware.

Figure 6A:
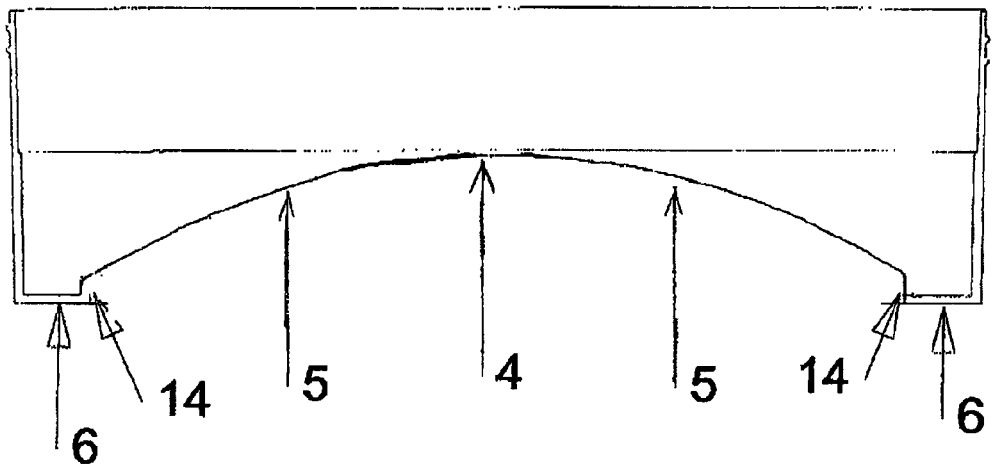
FIG. 6 is a sectional view of the container showing one or more of the novel aspects of the present invention.

FIG. **6*a* is a view similar to FIG. 6** but wherein the raised center portion of the base has a height approximately half the height of the outer wall portion.

DETAILED DESCRIPTION

Before explaining the present inventions in detail it is to be understood that the inventions are not limited in their application to the particular arrangements shown and described since the inventions are capable of other embodiments. Also, the terminology used herein is for the purpose of description and not of limitation.

Referring first to FIG. 2, one example of the novel device shown consists of three (3) parts; a receptacle or container (1), a coating element or assembly in the form of a rim dish (2) which, as an assembly, work together with a sponge (for example a donut-shaped sponge, not shown) or other substance to suspend a coating material, for example a wetting agent to apply on the rim of the beverage drink-ware and a closure in the form of a cover or lid (3). The container (1) and rim dish (2) are of a shape and a sufficient diameter (1*a*) and (1*b*) respectively, to accommodate large diameter drink-ware such as Martini, Rocks, Highball and other common drink-ware designs.

The receptacle or container 1 is configured and contoured as shown in FIG. 6, which includes a dome or other raised surface termed herein as a raised portion that elevates the center point of the container (4) and the raised portion gradually descends (5) toward the periphery of the container terminating at a preferably flat inner portion extending outward as a well, recess or other lower, collecting portion termed herein as a level plane (6) where the SPICE will congregate due to the forces of gravity. For example, any SPICE on the slope of the raised portion will migrate downward and outward to the level plane (6). This action takes advantage of gravity's presence on SPICE (dry granular, flaked, shaved or powdery substances) which will migrate away from the center point (4), down the descents (5) and toward the outer portion to the outer edge of the container's plane (6). The raised portion is preferably a continuous and smooth surface, and has a constant curvature between the outer plane steps (14) described below. Alternatively, the raised portion may follow other configurations, such as a straight rather than curved profile to a center peak, or otherwise.

The receptacle or container includes an outer wall extending upward and preferably substantially vertically from the level plane (6). The outer wall is high enough in the example shown to contain the SPICE. The height is also sufficient in the example to accept the rim dish (described below) and has an internal dimension large enough to accommodate most sizes of drink ware. Additionally, the outer dimension of the raised portion in the example shown is small enough to accommodate most sizes of drink ware without the drink ware rim contacting the raised portion when the drink ware is centered in the container. By way of example, conventional drink ware may have opening diameters of about four inches, plus or minus about two inches. The height of the outer wall is preferably at least as high as the depth of application of SPICE to the drink ware rim, and in some cases that depth is about ¼ inch, but in the example described, the height is preferably sufficient to also accommodate sealing with and/or nesting of other components such as the rim dish (2), for example about 2 inches.

Shown at FIG. 5, the device makes use of its Rim Dish (2) to provide an area for a sponge or other substance (7) to support and suspend a wetting agent for the purpose of applying moisture to the rim of the drink-ware when inverted and its rim is introduced and depressed into the sponge. The rim dish includes a base for supporting the sponge and any additional wetting agent, and a perimeter wall. The sponge preferably has an outer shape conforming to that of the rim dish, an open center portion and a relatively flat top to receive the rim of the drink ware. Further, the perimeter walls (8) of the rim dish (2) are of greater height than that of the sponge so as to avoid spilling of the liquid or overflow of the liquid when either liquid is poured onto the sponge and/or when drink-ware is depressed into a saturated sponge causing the amount of liquid the sponge or reservoir in the rim dish can suspend to be reduced, expelling liquid from the sponge/reservoir. The height of the perimeter walls of the rim dish may be at least as high as the depth of SPICE to be applied to the rim of the drink ware (which is approximately the depth of coating applied to the drink ware rim), for example about ¼ inch, but is preferably about ⅞ inches high. The perimeter walls may generally be about twice to three times the height of the sponge or other applicator.

Further, the rim dish is equipped with a raised structure in the form of an interior barrier wall (9) separating the sponge area from a raised and elevated manual holding area in the form of a finger and thumb grasp/post or other grasp point (10). The raised structure provides a protective wall for separating the wetting agent from the manual holding area, to reduce the possibility that the wetting agent area is touched or otherwise contaminated by material on a user's fingers. The raised structure also provides a grasping area by which the rimming dish can be moved or manipulated. The grasp point (10) is of greater height than that of the Sponge area (7) and also the interior barrier wall (9).

The device is preferably modular as shown in FIGS. 1, 2 and 3, and preferably fit and nest together allowing the rim dish (2) with its corresponding sponge area (7) to insert into the container (1) and to close securely with a snap on or screw top lid (3). The surfaces are preferably configured so as to provide a close and secure fit between them, reducing the possibility of contamination, and contributing to secure fitting together of the individual parts. The parts may fit together with an interference fit, complimentary fitting parts, interlocking parts, threaded parts or other forms for reliably fitting and/or nesting the parts together. While nesting of the parts provides for more reliable securement of the parts, and enhanced protection of the contents, nesting is not required to benefit from one or more of the features of the present inventions.

In the forms of the container (1) and rim dish (2) described herein, the dimensions of the outer wall surface of the rim dish (2) and the facing internal wall of the container are preferably configured so as to create an interference fit between the rim dish and the container where they mate. An interference fit plugs the container or otherwise helps to seal the contents of the container (1) with the rim dish (2). Alternatively, the lid (3) or other seal can be used to seal the container and/or protect the contents of the container. The junction between the container and the rim dish can also be threaded or snap on or another reliable junction. In the configuration of an interference fit, the outer surface dimension of the rim dish is preferably slightly tapered upward and outward. The taper allows reliable engagement between the rim dish wall and the container wall. The container wall may also be tapered outward and upward, but preferably less than the taper of the rim dish. Furthermore, the outer surface dimension of the rim dish is preferably less than the inner surface dimension of the container where the two surfaces meet, to give a reliable and relatively tight fit. The actual dimensions can be selected for the closeness of the fit between the surfaces and ease of removal of the rim dish from the container for use. Therefore, in use, the contents of the container can be covered and sealed using a structure containing and supporting the sponge or other material used to coat the drink ware.

The device helps to preserve and protect its contents, as shown in FIGS. 3 and 4, in among other ways, by having the container (1) fitted with a continuous ledge (11) around the interior circumference for the rim dish to rest against when the rim dish (2) in FIG. 3, is fully inserted into the said container to the extent desired. The rim dish (2) and the container (1) are preferably formed such as during molding so that the diameter of the rim dish (1*b*) enlarges gradually toward the top of the rim dish that becomes equal to and then slightly larger than the inside diameter of the container (1*a*). As shown in FIGS. 1 and 3, the rim dish (2) is fitted with an angled, preferably substantially horizontal ledge (12) that extends toward the outside circumference that hooks or rests on the top rim surface of the container (1). In FIG. 3, the outer dimension of the ledge 12 is preferably about equal to the thickness of the wall of the container on which the ledge 12 rests. As shown in FIG. 1, the lid (3) secures over the rim dish (2) and sponge/wetting agent reservoir (7) and onto the said container (1). Whereas the lid presses downward on the top of the said rim dish angle which then presses downward on the top rim of the container (1). The effect is a 'sandwiching' and sealing between the rim dish (2) and its contents from that of the container (1) and its contents. In the example shown in FIGS. 1-4 and 6, the container and lid have complimentary threads for securing the lid on the container and sandwiching the rim dish (2) between the lid and the upwardly-facing rim surface of the container. The rim dish is then fully enclosed within the combined lid and container. The drawings show the relative dimensions between the various parts of the assembly, and may be considered to be to scale, as discussed herein. The components may be formed, for example by molding, from food grade materials, including plastics, and the like.

These independent and substantially continuous contact points between the rim dish (2) and the container (1) in conjunction with the lid (3) afford three distinct seal points between these respective components and their contents.

Afore described, FIG. 5, shows the finger grasp (10) raised above the height of the barrier walls (9). FIG. 1, further portrays the height of the grasp (10) rising higher than the upper-most height of the ledge 12, and further shows the lid (3) with a raised center compartment (13) which accommodates the said raised finger/grasp point when the lid is closed. In the example shown, the upper surface of the grasp 10 and lower surface of the lid (3) make contact, and may also be dimensioned so that the grasp (10) slightly bows the lid upward, for example to help bias the seal given by the threaded engagement between the lid (3) and the container (1) as the lid is threaded onto the container. The barrier wall (9) may be slightly tapered inward and upward to the top surface. The grasp (10) preferably divides the area within the barrier wall (9) into two cavities sized sufficiently to allow the thumb and forefinger, for example, to fit comfortably. The depth of the two cavities is preferably greater than 50% of the height of the barrier wall (9) and may be about 70-75% of the height of the barrier wall (9). In use, the grasp can be used to insert and remove the rim dish (2) supporting the sponge or other coating agent into the container (1), and to move the rim dish (2) during use.

FIG. 3 shows the stacking function of the raised center compartment (13) of the lid (3) and the contoured container bottom (1) at its plane step (14). These contours allow for two or more dispensers to be securely stacked one on top of another. They also allow the lid to be stored under the container while the container is in use. Alternatively, the lid may be placed under the rimming dish (2) or to the side. The plane step can also be omitted, and the stacking capability incorporated in an external wall or other surface or engagement element on the underside of the container. Without the plane step, the raised portion or descends (5) may merge directly into the flat plane (6).

It will be apparent that a number of beneficial features can be included in apparatus and methods for rimming drink ware. Features include, but are not limited to:

1. A device to apply any dry granular, flaked, shaved or powder substance to the rim of drink-ware or other drinking container comprising the following, a container that is contoured comprising of a raised center, sloping descents and outer peripheral walls which extend upward and vertically relative to the desired depth of the SPICE and the desired diameter or dimension of the container.

A devise that consists of a rim dish, area for a wetting agent and lid and/or other components and/or parts that substantially perform the functions herein.

2. A method using apparatus such as that described above in paragraph numbered 1, wherein a rimming dish houses the wetting substance and its moisture that is separate from contact, evaporation and/or contamination of the SPICE.
3. A method such as that described above in paragraph numbered 2, wherein said rimming dish is of greater depth and height relative to the height of the wetting agent and/or its supporting substance (e.g. sponge).

A compartment that averts spilling or overflow of wetting agent when either poured onto the sponge and/or when drink-ware is introduced into a saturated wetting sponge causing the amount of liquid the sponge and rim dish can suspend or hold to be reduced, expelling liquid from the sponge and rim dish.

4. A method such as that described above in paragraph numbered 2, wherein said rimming dish has a barrier separating the sponge and wet areas from a raised and elevated finger and thumb grasp, post or other separation and grasp point, also of greater height than that of the sponge and sponge barriers.
5. A method such as that described above in paragraphs numbered 1 and 2, wherein said rim dish and sponge which may together insert into and/or nest into the interior of the said container.

Whereas the rim dish has an angled ledge that extends toward its outer circumference that hooks over the top rim of the said container when inserted fully into the container.

6. A method such as that described above in paragraph numbered 1, wherein a re-closable lid, either screw top or snap on, that secures over the rim dish, sponge and wetting agent and onto the said container.
7. A method such as that described above in paragraph numbered 1, wherein said rim dish nests into the said container and said lid closes, seals and secures the contents in the rim dish and container.

Whereas when the lid is secured to the container, it presses down on the top of the said rim dish ledge which presses down on the top rim of the said container.

The bottom underside perimeter of the rim dish rests on a ledge built into the interior wall of the container which creates a continuous contact point at the under side perimeter of the rim dish.

The diameter of the rim dish enlarges gradually toward the top of the rim dish and becomes equal to and then slightly larger than the inside diameter of the container. The diameter intersection cause a continuous contact and seal point between the rim dish and the container as the rim dish is inserted and then depressed into the container.

8. A method such as that described above in paragraphs numbered 4 and 6, wherein said lid has a raised center compartment of the lid to accommodated the said raised grasp point of the said rim dish.
9. A method such as that described above in paragraph numbered 1, wherein said 2 or more dispensers may stack securely one on the top of another.

A raised center compartment in the lid with contoured grooves, fittings and/or elevations to fit under the bottom of the said contoured container.

10. A method such as that described above in paragraph numbered 1, wherein said container is made of a translucent and or transparent material allowing a user to identify its contents by viewing said contents through the material of the container.

11. A method such as that described above in paragraph numbered 6, wherein said lid may be a screw top lid that is greater than 120 (one hundred twenty) millimeters in diameter.

Having thus described several exemplary implementations of the invention, it will be apparent that various alterations and modifications can be made without departing from the inventions or the concepts discussed herein. Such operations and modifications, though not expressly described above, are nonetheless intended and implied to be within the spirit and scope of the inventions. Accordingly, the foregoing description is intended to be illustrative only.

What is claimed is:

1. A receptacle for receiving a material to be placed on a beverage container, the receptacle comprising:

a closed body portion having an upper rim defining an opening into the receptacle, an outer wall portion extending downwardly a first distance from the upper rim to a base portion, wherein the first distance is between one-quarter and 2 inches, the base portion having a substantially flat surface facing upwardly toward the opening and extending inwardly toward a center from the outer wall portion to a raised portion, wherein the base portion is configured to support a granular material and sized sufficiently to receive an open rim of a beverage container and wherein a largest dimension of the base portion across the body is greater than 4 inches, wherein the raised portion extends inwardly from the base portion substantially constantly upwardly toward a center of the receptacle and wherein the raised portion has a vertical height approximately half the first distance and a largest dimension of the raised portion across the body is between approximately 2 and 4 inches, and wherein the raised portion is configured to allow a granular material to move under the force of gravity toward the base portion.

2. The receptacle of claim 1 wherein the raised portion is substantially convex.

3. The receptacle of claim 2 wherein the raised portion has a substantially constant curvature.

4. The receptacle of claim 1 wherein the outer wall portion is substantially vertical.

5. The receptacle of claim 4 wherein the raised portion includes a substantially vertical wall joined to the base portion.

6. A receptacle for receiving a material to be placed on a beverage container, the receptacle comprising:

a round container having an upper rim defining an opening into the container, an outer wall portion extending vertically downwardly a first distance from the upper rim to a base portion, wherein the first distance is between one-quarter inch and 2 inches, the base portion having a substantially flat surface facing upwardly toward the opening and extending inwardly toward a center from the outer wall portion to a raised portion, wherein the raised portion extends inwardly from the base portion substantially constantly upwardly toward a center of the receptacle and wherein the raised portion has a vertical height approximately half the first distance; and a rimming dish sized to fit at least partly within the round container, the dish having a first recessed area for receiving a coating material for coating a rim of a drink ware, and also having a raised area in the dish sized sufficiently to allow manual grasping of the raised area and wherein the raised area includes a wall defining an outer perimeter of the raised area and wherein the raised area further includes a second recessed area within the wall.

7. The receptacle of claim 6 further including a lid sized to fit over the container rim.

8. The receptacle of claim 6 wherein the raised area extends beyond the level of the upper rim.

9. The receptacle of claim 6 wherein the second recessed area includes a raised portion extending substantially upward to separate the second recessed area into first and second regions.

10. The receptacle of claim 9 wherein the raised portion is a diametrically extending wall dividing the first and second regions.

11. The receptacle of claim 10 wherein the diametrically extending wall extends above the upper rim.

12. The receptacle of claim 6 wherein the recessed area and the raised area each occupy respective surface areas in the rimming dish and wherein the recessed area surface area is greater than the raised area surface area.

13. A receptacle comprising:

a receptacle wall extending upwardly from a bottom portion of the receptacle wall to a receptacle rim, wherein the receptacle rim defines an opening having a size sufficient to receive the open rim of an item of drink ware and wherein the largest distance across the opening is greater than 4 inches and wherein the receptacle rim has an upper surface;

a bottom wall joining the receptacle wall at the bottom portion of the receptacle wall, the bottom wall having a relatively flat section adjacent the receptacle wall and a raised portion interior to the relatively flat section and wherein the raised portion extends upward to an upper position above the relatively flat section and below the receptacle rim, wherein the upper position is greater than or equal to about one-half inch and less than two inches, wherein the raised portion has a largest distance across the receptacle between 2 and 4 inches and wherein the opening size is greater than a distance from the bottom portion to the receptacle rim; and the receptacle wall and the bottom wall comprising a molded plastic construction.

14. The receptacle of claim 13 wherein the upper position is about one-half inch.

15. The receptacle of claim 13 wherein the raised portion has a curvature over substantially the entire surface of the raised portion.

16. The receptacle of claim 13 wherein the receptacle wall includes threads on an upper outer surface thereof to accept with a threaded engagement a threaded lid.

17. The receptacle of claim 13 wherein the raised portion is configured to allow a granular material to move under the force of gravity toward the relatively flat section, and the relatively flat section is configured to support the granular material.

18. A receptacle for receiving granular material to be placed on an open rim of a beverage container, the receptacle comprising:

an outer wall portion having a bottom portion;

a base portion ioininci the outer wall portion at the bottom portion;

the base portion including a raised portion having a convex shape and extending upward and toward the center of the receptacle a first distance between approximately 1/2 inch and less than two inches;

the raised portion being substantially circular and having an outer diameter between approximately two inches and approximately four inches;

the base portion including a surrounding portion having a substantially flat surface that surrounds the raised portion; and the outer wall portion extending at least partly upwardly a second distance greater than the first distance to a top rim forming an open receptacle opening that has a maximum opening dimension greater than the second distance;

wherein the outer wall portion and the base portion comprise a molded plastic construction.

19. A receptacle for receiving granular material to be placed on an open rim of a beverage container, the receptacle comprising:

an outer wall portion having a bottom portion;

a base portion joining the outer wall portion at the bottom portion;

the base portion including a raised portion having a convex shape and extending upward and toward the center of the receptacle a first distance between approximately 1/2 inch and less than two inches;

the raised portion being substantially circular and having an outer diameter between approximately two inches and approximately four inches;

the base portion including a surrounding portion having a substantially flat surface that surrounds the raised portion; and the outer wall portion extending at least partly upwardly a second distance greater than the first distance to a top rim forming an open receptacle opening that has a maximum opening dimension greater than the second distance;

wherein the outer wall portion includes snap-on protrusions on an upper outer surface thereof and spaced below the rim to accept a snap-on lid.

20. A receptacle for receiving granular material to be placed on an open rim of a beverage container, the receptacle comprising:

an outer wall portion having a bottom portion;

a base portion joining the outer wall portion at the bottom portion;

the base portion including a raised portion having a convex shape and extending upward and toward the center of the receptacle a first distance between approximately 1/2 inch and less than two inches;

the raised portion being substantially circular and having an outer diameter between approximately two inches and approximately four inches;

the base portion including a surrounding portion having a substantially flat surface that surrounds the raised portion; and the outer wall portion extending at least partly upwardly a second distance greater than the first distance to a top rim forming an open receptacle opening that has a maximum opening dimension greater than the second distance;

wherein the outer wall portion includes threads on an upper outer surface thereof to accept with a threaded engagement a threaded lid.

21. A receptacle for receiving granular material to be placed on an open rim of an item of drinkware, the receptacle comprising:

an outer wall portion having a bottom portion;

a base portion ioining the closed wall portion at the bottom portion;

the base portion including a raised dome portion and a surrounding portion;

the raised dome portion extending upward and toward a center of the receptacle a first distance between approximately % inch and two inches;

the raised dome portion being substantially circular and having an outer diameter between approximately two inches and approximately four inches;

the surrounding portion ioining the outer wall portion, facing upwardly and surrounding the raised dome portion; the outer wall portion extending at least partly upwardly a second distance greater than the first distance to a receptacle rim forming a receptacle opening that has a maximum opening dimension greater than the second distance: the raised dome portion being configured to allow a granular material to move under the force of gravity from the raised dome portion toward the surrounding portion: and the surrounding portion being configured to support the granular material and being sized sufficiently to receive an open rim of an item of drinkware inserted in through the receptacle opening; wherein the outer wall portion and the base portion are a plastic construction.

22. The receptacle of claim 21 wherein the surrounding portion is flat.

23. A receptacle for receiving granular material to be placed on an open rim of an item of drinkware, the receptacle comprising:

an outer wall portion having a bottom portion:

a base portion ioining the closed wall portion at the bottom portion;

the base portion including a raised dome portion and a surrounding portion;

the raised dome portion extending upward and toward a center of the receptacle a first distance between approximately 1/2 inch and two inches:

the raised dome portion being substantially circular and having an outer diameter between approximately two inches and approximately four inches;

the surrounding portion ioining the outer wall portion, facing upwardly and surrounding the raised dome portion;

the outer wall portion extending at least partly upwardly a second distance greater than the first distance to a receptacle rim forming a receptacle opening that has a maximum opening dimension greater than the second distance;

the raised dome portion being configured to allow a granular material to move under the force of gravity from the raised dome portion toward the surrounding portion; and the surrounding portion being configured to support the granular material and being sized sufficiently to receive an open rim of an item of drinkware inserted in through the receptacle opening;

wherein the outer wall portion includes threads on an upper outer surface thereof to accept with a threaded engagement a threaded lid.

24. A receptacle comprising:

a receptacle wall extending upwardly from a bottom portion of the receptacle wall to a receptacle rim, wherein the rim defines an opening having a size sufficient to receive the open rim of an item of drinkware and wherein the largest distance across the opening is greater than four inches and wherein the receptacle rim has an upper surface;

a bottom wall joining the receptacle wall at the bottom portion of the receptacle wall, the bottom wall having a relatively flat section adjacent the receptacle wall and a raised portion interior to the relatively flat section and wherein the raised portion extends upward to an upper position above the relatively flat section and below the receptacle rim wherein the upper position is greater than or equal to about one-half inch and less than two inches, wherein the raised portion has a largest distance across the receptacle between two and four inches and wherein the opening size is greater than a distance from the bottom portion to the receptacle rim; and the receptacle wall includes (1) at least one protrusion on an upper outer surface thereof and spaced below the receptacle rim to accept a snap-on lid for the receptacle or (2) threads on an upper outer surface thereof to accept a threaded lid for the receptacle.

25. A receptacle for receiving a granular material to be placed on a rim of a beverage container, the receptacle comprising:

a container having an upper rim defining a container opening, an outer wall portion extending vertically downwardly a first distance from the upper rim to a base portion, wherein the first distance is between one-quarter inch and two inches, the base portion having a substantially flat surface facing upwardly toward the container opening and extending inwardly toward a center from the outer wall portion to a raised portion, wherein the raised portion extends inwardly from the base portion substantially constantly upwardly toward a center of the receptacle and wherein the raised portion has a vertical height approximately half the first distance; and a rimming dish sized to fit at least partly within the container, the dish having a first recessed area configured to receive a coating material for coating a rim of a beverage container.

26. The receptacle of claim 25 wherein the rimming dish has a raised area that includes a wall defining an outer perimeter of the raised area and wherein the raised area further includes a second recessed area within the wall.

27. The receptacle of claim 26 wherein the second recessed area includes a raised portion extending substantially upward to separate the second recessed area into first and second regions.

28. The receptacle of claim 27 wherein the raised portion is a diametrically extending wall dividing the first and second regions.

29. The receptacle of claim 28 wherein the diametrically extending wall extends above the upper rim.

30. The receptacle of claim 26 wherein the recessed area and the raised area each occupy respective surface areas in the rimming dish and wherein the recessed area surface area is greater than the raised area surface area.

31. The receptacle of claim 26 wherein the raised area extends beyond the level of the upper rim.

32. The receptacle of claim 25 wherein the diameter of the container opening is greater than the first distance.

* * * * *